United States Patent [19]

Mackenzie

[11] Patent Number: 4,604,055

[45] Date of Patent: Aug. 5, 1986

[54] LIP-HUNG RETORT FURNACE

[75] Inventor: Peter B. Mackenzie, Fonthill, Canada

[73] Assignee: Can-Eng Holdings, Ltd., Canada

[21] Appl. No.: 740,749

[22] Filed: Jun. 3, 1985

[51] Int. Cl.[4] ..... C21D 9/00

[52] U.S. Cl. ..... 432/58; 266/255; 266/257; 432/199

[58] Field of Search ..... 432/58, 15, 198, 199; 266/255, 257

[56] References Cited

U.S. PATENT DOCUMENTS

| | | | |
|---|---|---|---|
| 2,070,416 | 2/1937 | Sturges | 266/255 |
| 2,176,473 | 10/1939 | Rosecrans | 266/257 |
| 2,541,857 | 2/1951 | Besselman et al. | 266/255 |
| 2,630,315 | 3/1953 | Munford | 432/199 |
| 2,686,665 | 8/1954 | Tauber et al. | 266/255 |
| 3,666,253 | 5/1972 | Yoshio et al. | 266/257 |
| 4,071,961 | 2/1978 | Dietzel et al. | 432/103 |
| 4,171,949 | 10/1979 | Endersen | 432/103 |
| 4,524,957 | 6/1985 | Staffin et al. | 266/257 |

*Primary Examiner*—Henry C. Yuen
*Attorney, Agent, or Firm*—Davis Chin

[57] ABSTRACT

A fluidized bed furnace includes a furnace housing having an outer shell. A furnace base and an outer top plate are secured to the respective lower and upper ends of the housing. A vertical retort has an opened upper end and an opened lower end. The retort is arranged in an opening formed in the outer top plate and extends downwardly into the center of the housing. Heat insulating material is disposed between the outer shell and the vertical retort. A retort base assembly is used to close the lower end of the retort. An upper support device is formed integrally with the retort at its upper end for supporting the vertical retort on top of the outer top plate so as to permit downward growth only during thermal expansion. A lower support device is interposed between the lower surface of the retort base assembly and the upper surface of the furnace base which supports substantially all the weight of the retort, the weight of the load of fluidizable media and the weight of a load of material to be heat treated.

8 Claims, 3 Drawing Figures

LIP-HUNG RETORT FURNACE

BACKGROUND OF THE INVENTION

This invention relates generally to fluidized bed furnaces and more particularly, it relates to a fluidized bed furnace having a vertical retort.

In recent years, there has been an increased demand for furnaces in which a charge or work may be heated through high temperatures. There are a number of problems associated with the heat-treating of a material to high temperatures which have not heretofore been adequately solved by the prior art furnaces. One of the problems that existed in the prior art is the failure to create a well sealed enclosure for the work or charge to be heated so as to prevent loss of the fluidizable media. Since it is well known that high temperatures and pressures are required in furnace applications, there has been encountered another problem of fabricating a retort structure which will allow for thermal growth. In other words, there is a need to develop a retort structure which prevents structural cracks in the sidewalls as the result of internal pressures produced by the load in the retort or the influence of gases or as a result of the expansion or contraction of the materials forming the retort when they are heated and cooled through a wide range of temperatures. Still another problem experienced in the prior art furnaces is that the retorts have a short service life due to the fact that they cannot withstand prolonged periods of operation without the development of cracks or fractures in the body of the retort.

Therefore, it would be desirable to provide a fluidized bed furnace having a vertical retort which has an effective seal and allows for thermal growth so as to increase its service life. The retort of the present invention is supported and sealed at its top at a fixed position which permits downward growth only during thermal expansion. Further, a lower support structure is provided at the bottom or lower end of the present retort so as to take up a substantial amount of the load when thermal growth of the retort occurs.

SUMMARY OF THE INVENTION

Accordingly, it is a general object of the present invention to provide an improved fluidized bed furnace having a vertical retort which is relatively simple and economical to manufacture and assemble, but yet overcomes the disadvantages of the prior art furnaces.

It is an object of the present invention to provide a fluidized bed furnace having a vertical retort which has an effective seal and allows for thermal growth so as to increase its service life.

It is another object of the present invention to provide a fluidized bed furnace having a vertical retort which is supported and sealed at its top at a fixed position so as to permit downward growth only during thermal expansion.

It is still another object of the present invention to provide a fluidized bed furnace which includes a lower support structure for supporting a substantial amount of the load when thermal growth of the retort occurs.

In accordance with these aims and objectives, the instant invention is concerned with the provision of a fluidized bed furnace which includes a furnace housing formed of a generally rectangular outer shell. A furnace base and a rectangular outer top plate are secured to the respective lower and upper ends of the housing. A vertical retort is formed of a generally cylindrical contour and has an opened upper end and an opened lower end. The retort is arranged in an opening formed in the rectangular outer top plate and extends downwardly into the center of the housing. Heat insulating material is interposed between the furnace housing and the cylindrical retort. A generally horizontal member formed integrally with the retort is used for supporting its upper end. A retort base assembly is used for closing the lower end of the retort. The horizontal member defines an upper support structure which supports the vertical retort on top of the outer top plate so as to permit downward growth only during thermal expansion. A lower support structure interposed between the lower surface of the retort base assembly and the upper surface of the furnace base supports substantially all of the weight of the retort, the weight of a load of fluidizable media, and the weight of a load of material to be heat treated.

BRIEF DESCRIPTION OF THE DRAWINGS

These and other objects and advantages of the present invention will be more fully apparent from the following detailed description when read in conjunction with the accompanying drawings with like reference numerals indicating corresponding parts throughout.

DESCRIPTION OF THE PREFERRED EMBODIMENTS

Figure 1:
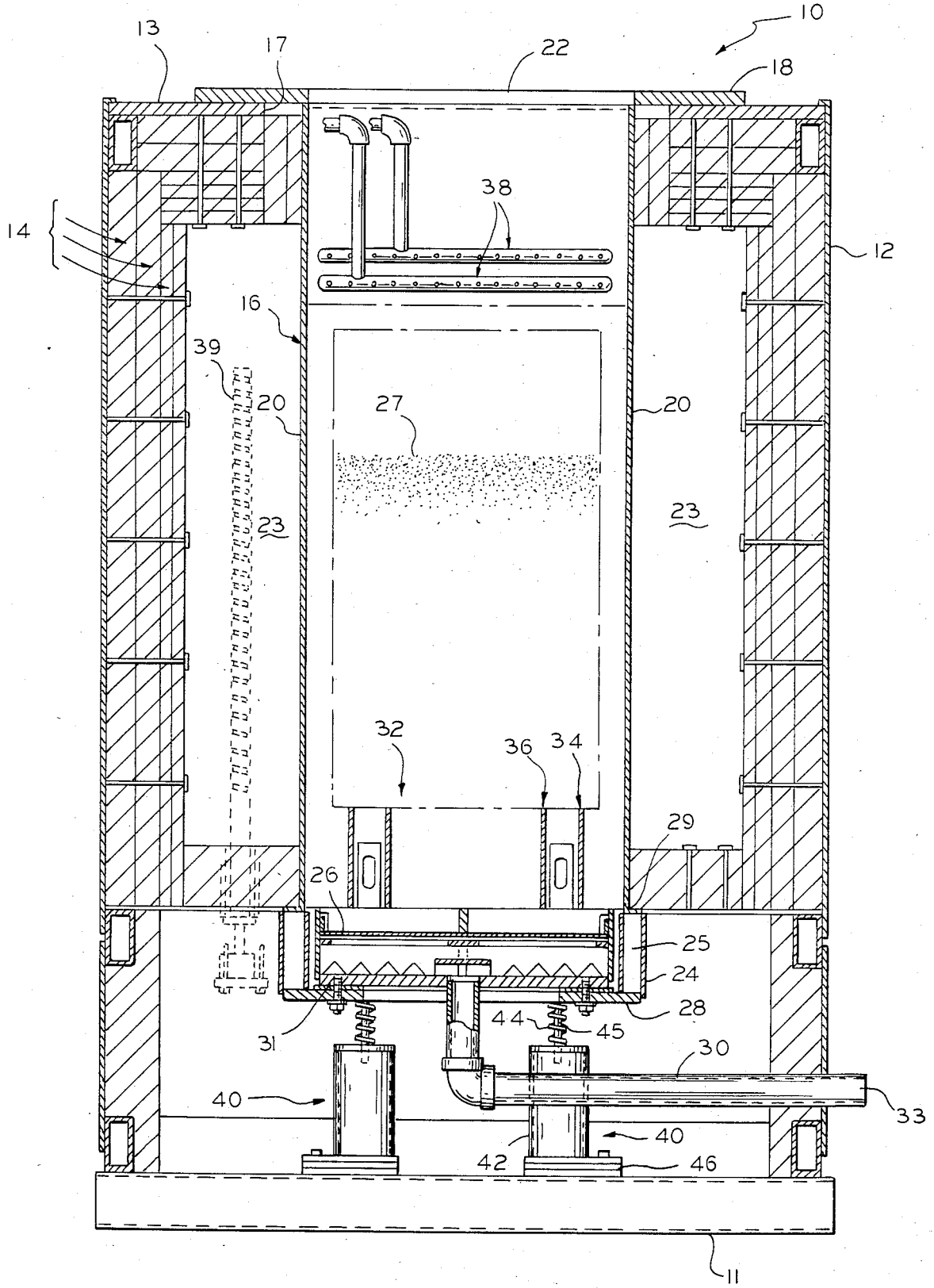
FIG. 1 is a cross-sectional view of a fluidized bed furnace constructed in accordance with the principles of the present invention.
Figure 2:
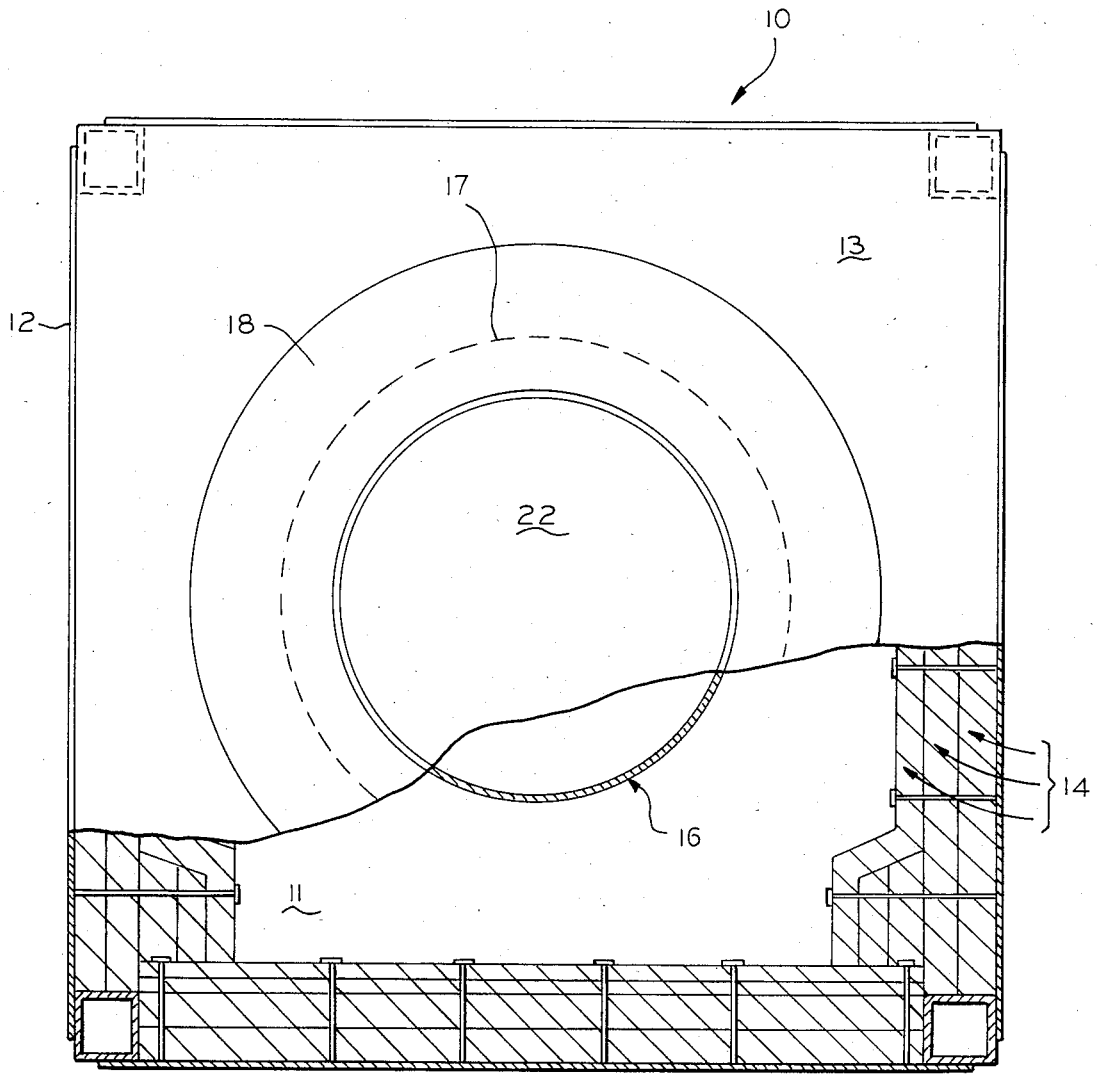
FIG. 2 is a top plan view of the furnace of FIG. 1 with a portion thereof shown in section.

Referring now in detail to the various views of the drawings, there are shown in FIGS. 1 and 2 a fluidized bed furnace 10 which is enclosed by a housing formed of a rectangular outer shell 12 for surrounding one or more layers of heat insulating materials 14. While the outer shell 12 has been illustrated in a generally rectangular shape, it should be clear that the outer shell may be formed with any other suitable shape as desired. The furnace also includes a bottom base 11 and a rectangular outer top plate 13 which are suitably connected to the respective lower and upper ends of the outer shell 12. The heat insulating material 14 is preferably formed of three layers of ceramic fibers which are in total approximately six inches in thickness.

A vertical retort 16 having a generally cylindrical contour is provided with an opened upper end and an opened lower end. The vertical retort is disposed within the center of the furnace 10 via an opening 17 formed in the rectangular outer top plate 13. The retort 16 is provided at its upper end with a generally horizontal member 18 which is formed integrally with the sidewalls 20. The flat top member 18 defines an annular flange which extends horizontally from the sidewalls 20. The annular flange 18 has a central opening 22 which forms the opened upper end of the retort 16. It should be understood to those skilled in the art that the retort may be constructed to have an oval, rectangular, square and the like shape in its cross-sectional area for certain applications.

The annular flange 18 serves as a lip-hung support member for supporting and fixedly securing at a fixed location the retort 16 on top of the outer top plate 13 of the furnace. Further, the flange 18 in use provides a non-moving seal between the upper end of the retort and the outer top plate of the furnace so as to create a reasonably tight structure. This tight seal serves to prevent gravity fluing from cavity 23 or migration of fluidizable media which has exited the opened upper end of the retort via the opening 22 from infiltrating back down into cavity 23. Since the upper end of the retort is adapted to be fixedly mounted to the outer surface on the top plate 13 and extends downwardly from this fixed location into the center of the housing, it is permitted to grow downward only during thermal expansion.

The opened lower end of the retort 16 is closed by a bottom base assembly 24 which includes an air cooling channel 25 and a bottom disc member 28. The channel 25 surrounds the lower end of the retort and is suitably affixed, such as by welding, at its top end 29 to the sidewalls 20 of the retort 16. The bottom disc member 28 supports and secures fixedly, such as by bolts, an air/gas distribution plenum 31 to the lower end of the retort. The plenum 31 contains a porous media 26 at its top surface so as to provide uniform distribution of the air/gas up into the bottom of the fluidizable media.

Within the central portion of the retort, there is provided a mass of discrete particles or fluidizable media 27 which is fluidized during use by a gaseous media flowing upward through the porous media 26. Typically, this fluidizable media of particles 27 consist of a weight of approximately 3000 pounds, and the weight of the material to be heat treated or processed may be as high as 800 pounds which both act down on the retort base assembly 24. The vertical retort 16 of the preferred embodiment has a diameter of about 2½ feet and a height of approximately 6 feet.

Beneath the porous media 26, there is provided a gas/air conduit means such as a pipe 30 with inlet 33 through which the gaseous media will flow from any suitable sources (not shown) of air or process gas. The conduit means supplies the fluidizing or gaseous media to the underside of the bottom retort base assembly 24 from which the gaseous media will flow through the porous media and into the mass of discrete particles 27. The process gases are generally premixed before delivery to the underside of the porous media so that a proper mixture is arranged dependent upon the treatment that is required to be given to the work or charge components to be immersed in the mass of discrete particles 27 when fluidized. A work support grid 32 typically formed of an outer ring 34 and an inner ring 36 are utilized to support a basket and the like containing such components which are to be heat treated.

A second gas/air conduit means formed of submerged combustion rings 38 is provided for admitting into the upper part of the bed air and a combustible gas. The rings 38 are located adjacent to the top of the bed, but beneath the upper surface of the mass of discrete particles 27 when they are fluidized. This now forms a combustible mixture which will ignite and provide combustion within the upper part of the bed. While the method of heating the bed is typically achieved by such submerged combustion rings 38, it should be understood that heating of the bed may also be done through the use of electric heating elements 39. In such alternate use of the heating elements 39, it is preferable to provide six of them which are disposed in the cavity 23 between insulating layers 14 and the sidewalls 20 of the retort.

A resilient support structure 40 is arranged for supporting the lower end of the retort. The support structure 40 is interposed between the lower surface of the bottom disc member 28 of the retort base assembly 24 and the upper surface of the furnace base 11. This support structure 40 includes a support block member 42, a coiled spring 44, a guide rod 45, and lower shims 46. The support structure 40 is used to support substantially all of the weight of the retort 16, the weight of the load of the fluidizable media or discrete particles 27 and the weight of the load of the material (charge components) to be heat treated during downward thermal growth.

One end of the block member 42 is adapted to receive one end of the guide rod 45. The other end of the guide rod 45 is suitably attached to the bottom disc member 28 of the retort base assembly 24. The lower shims 46 are in contacting relationship or engagement with the other end of the block number 42 for bearing against the top surface of the furnace base 11. The coiled spring 44 is disposed in surrounding relationship with the guide rod 45. The ends of the coiled spring 44 are in contacting relationship for bearing against the lower surface of the disc member 27 and the upper surface of the support block member 42, respectively.

In view of the relative length-to-diameter ratio of the retort 16, it is assumed that the majority of the metallurgical permanent retort growth will be occurring vertically. Thus, the support structure 40 may be adjusted to compensate for the permanent growth by removing some or all of the lower shims 46 over the expected service life of the retort. It should be understood that the lower support structure 40 will also minimize the relatively high tensile stress which exists in the retort along its vertical axis due to the fact that it takes most of the weight of the loads, thereby preventing cracks or leakage from occurring in its sidewalls. As a result, this tends to increase the service life of the retort as well. While only two resilient structure 40 have been shown in the drawings, it should be apparent that any number may be used as desired. In the preferred embodiment, four such support structures 40 are utilized which are equally spaced beneath the retort base assembly 24.

Figure 3:
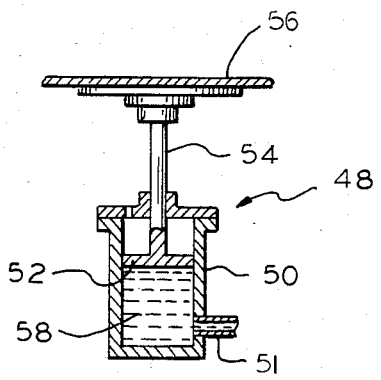
FIG. 3 is an alternate embodiment of a lower support structure for the furnace of FIG. 1.

As an alternate embodiment to the support structure 40, a hydraulic-actuated support structure 48 is shown in FIG. 3 of the drawings. The support structure 48 includes hydraulic means formed of a cylinder 50 and a piston 52 disposed movably within the cylinder 50. A shaft 54 has its one end mechanically coupled to the piston 52. A plate member 56 is mechanically coupled to the other end of the shaft 54. As growth occurs in the retort, fluid 58 will be delivered into the cylinder 50 via a supply line 51 from a hydraulic pressure supply (not shown). The amount of fluid supplied is precisely controlled to provide an upward thrust so as to compensate for the downward expansion during thermal growth and loading of the retort. As can be seen, the hydraulic pressure is exerted on the piston 52 which in turn pushes on the plate member 56 via the shaft 54.

Again, it should be understood that any number of hydraulic-actuated support structures 48 could be used. In the preferred embodiment, there are provided four support structures 48 which are equally spaced beneath the retort base assembly 24. It should be clear to those skilled in the art that the fluid could be replaced with a gaseous medium, such as air, supplied from a pneumatic system.

From the foregoing detailed description, it can thus be seen that the present invention provides an improved fluidized bed furnace having a vertical retort which has an effective seal that allows for thermal growth so as to increase its service life. An upper support device is provided for supporting the vertical retort at its upper end so as to permit downward growth only during thermal expansion. Further, a lower support device is provided at the lower end of the retort for supporting substantially all of the weight of the retort, the weight of the load of a fluidizable media, and the weight of a load of materials to be heat treated.

While it has been illustrated and described what are at present to be preferred embodiments of the present invention, it will be understood by those skilled in the art that various changes and modifications may be made, and equivalents may be substituted for elements thereof, without departing from the central scope thereof. Therefore, it is intended that this invention not be limited to the particular embodiments disclosed as the best modes contemplated for carrying out this invention but that the invention will include all embodiments falling within the scope of the appended claims.

What is claimed is:

1. A fluidized bed furnace comprising:

a furnace housing including an outer shell;

a furnace base and an outer top plate secured to the respective lower and upper ends of said furnace housing;

a vertical retort having an opened upper end and an opened lower end, said retort being disposed in an opening formed in said outer top plate and extending downwardly into the center of said furnace housing;

heat insulating material disposed between said outer shell and said vertical retort;

a retort base assembly being adapted for closing the lower end of said vertical retort;

upper support means for supporting the upper end of said vertical retort on top of said outer top plate so as to permit downward growth only during thermal expansion;

said upper support means including an annular flange formed integrally with the sidewalls of said retort at the upper end thereof and being adapted to be fixedly mounted to the outer surface of the outer top plate;

lower support means interposed between the lower surface of said retort base assembly and the upper surface of said furnace base for supporting substantially all the weight of said retort, the weight of the load of a fluidizable media, and the weight of a load of material to be heat treated; and said lower support means including at least one resilient support device consisting of a block member, a coiled spring, a guide rod, and lower shims, wherein on end of said block member is adapted to receive one end of said guide rod, the other end of said guide rid being attached to said retort base assembly, said lower shims being in contacting engagement with the other end of said block member for bearing against the upper surface of sand furnace base, said coiled spring being disposed in surrounding relationship with said guide rod, the ends of said coiled spring being in contacting engagement for bearing against the lower surface of said retort base assembly and the upper surface of said block member respectively.

2. A fluidized bed furnace as claimed in claim 1, wherein said upper support means serves to create a tight non-moving seal between the retort and the outer top plate so as to prevent gravity fluing and migration of the fluidizable media.

3. A fluidized bed furnace as claimed in claim 1, wherein the number of lower shims is reduced so as to compensate for permanent growth.

4. A fluidized bed furnace as claimed in claim 1, wherein said vertical retort has a diameter of approximately $2\frac{1}{2}$ feet and a height of approximately 6 feet.

5. A fluidized bed furnace as claimed in claim 1, wherein said lower support means comprises a plurality of resilient support devices, each resilient device consisting of a block member, a coiled spring, a guide rod and lower shims.

6. A fluidized bed furnace as claimed in claim 1, wherein said lower support means comprises four resilient support devices which are equally spaced beneath the lower surface of the retort base assembly.

7. In a fluidized bed furnace having a furnace housing, a furnace base, a vertical retort disposed within the housing, the vertical retort containing a mass of discrete particles, a retort base assembly closing the lower end of the retort, and conduit means for supplying a gaseous media to the underside of the retort base assembly from which the gaseous media will flow through the retort base assembly and into the mass of discrete particles, the improvement comprising:

upper support means for supporting the upper end of said vertical retort on top of said housing so as to permit downward growth only during thermal expansion;

said upper support means including an annular flange formed integrally with the sidewalls of said retort at the upper end thereof and being adapted to be fixedly mounted to the outer surface of the outer top plate;

lower support means interposed between the lower surface of said retort base assembly and the upper surface of said furnace base for supporting substantially all the weight of said retort, the weight of the load of the discrete particles, and the weight of a load of material to be heat treated; and said lower support means including at least one resilient support device consisting of a block member, a coiled spring, a guide rod, and lower shims, wherein said lower support means comprises a plurality of resilient support devices each consisting of a block member, a coiled spring, a guide rod and lower shims.

8. In a fluidized bed furnace as claimed in claim 7, wherein said upper support means serves to create a tight non-moving seal between the retort and the housing so as to prevent gravity fluing and migration of the discrete particles.

* * * * *